US006487797B1

(12) United States Patent
Inoue et al.

(10) Patent No.: US 6,487,797 B1
(45) Date of Patent: Dec. 3, 2002

(54) SPEED/FORCE ADJUSTABLE IMPLEMENT LINKAGE FOR AN EXCAVATOR

(75) Inventors: Yonezo Inoue, Chattanooga, TN (US); Allen E. Kimble, Rock Spring, GA (US)

(73) Assignee: JRB Company, Inc., Akron, OH (US)

( * ) Notice: Subject to any disclaimer, the term of this patent is extended or adjusted under 35 U.S.C. 154(b) by 0 days.

(21) Appl. No.: 09/698,397

(22) Filed: Oct. 27, 2000

Related U.S. Application Data

(60) Provisional application No. 60/161,983, filed on Oct. 28, 1999.

(51) Int. Cl.[7] ..... B66C 3/02
(52) U.S. Cl. ..... 37/188
(58) Field of Search ..... 37/188, 461, 399, 37/187, 186, 430, 428, 412, 236

(56) References Cited

U.S. PATENT DOCUMENTS 3,375,595 A * 4/1968 Beltrami
3,510,017 A * 5/1970 Guinot
3,640,005 A * 2/1972 Chiarolanza et al.

* cited by examiner

*Primary Examiner*—Christopher J. Novosad
(74) *Attorney, Agent, or Firm*—Fay, Sharpe, Fagan, Minnich & McKee, LLP

(57) ABSTRACT

An implement linkage for an excavator, backhoe, or like apparatus is provided wherein the speed and force (speed/force) characteristics of the linkage, and the implement connected thereto, are selectively variable by an end-user depending upon the task to be performed with the implement.

8 Claims, 4 Drawing Sheets

SPEED/FORCE ADJUSTABLE IMPLEMENT LINKAGE FOR AN EXCAVATOR

CROSS-REFERENCE TO RELATED APPLICATION

This application claims priority from and hereby expressly incorporates by reference U.S. provisional application Ser. No. 60/161,983 filed Oct. 28, 1999.

BACKGROUND OF THE INVENTION

The present invention relates generally to an improved linkage adapted for operatively connecting buckets and other implements to an arm of an excavator or like apparatus. In particular, the present invention relates to an improved implement linkage for an excavator that is adapted for being adjusted to improve digging efficiency by varying the speed and force characteristics of the linkage as desired depending upon the particular task to be performed. For ease of understanding the invention, it will be described with particular reference to excavators and the connection of a bucket implement to the arm of the excavator. Of course, those of ordinary skill in the art will appreciate that the invention has wider application and provides a speed/force adjustable linkage for connecting any implement to the boom or arm of any apparatus such as a backhoe, tractor, or the like.

Excavators are well known and widely used in various industries. Typically, such excavators include a boom extending from a base of the excavator to an outwardly and upwardly extending distal end, at which end an arm (or "dipper stick") is attached. The arm pivots relative to the boom, and the distal end of the arm is adapted for operative securement of an implement thereto such as a shovel or bucket for removing and depositing earth or the like. Other industries, such as the materials handling industry, employ shears, grapples, magnets, and other such devices at the distal end of the arm. Regardless of the type of implement employed at the end of the arm, it will be understood by those skilled in the art that an excavator employs fluid cylinders and the like for raising and lowering the boom, the arm, for moving the implement relative to the arm, and for operating any mechanisms of the implement, itself.

In a most basic arrangement, the implements are manually pinned to the excavator arm and any associated fluid cylinders by way of a linkage assembly. Such operation necessarily requires manual removal and replacement of multiple pins to achieve the desired engagement. The removal and placement of such pins involves manually and hydraulically manipulating the heavy and cumbersome arm, a fluid cylinder, and/or the implement.

More recently, quick couplings have been developed and have enjoyed widespread commercial success. One suitable coupling is commercially available from JRB Company, Inc., Akron, Ohio under the trademark SLIDE-LOC®. Such quick couplings are pinned to the distal end of the arm and, once in place, are adapted for selective connection to any of a wide variety of implements as desired in a convenient and secure manner. More particularly, these prior quick couplings include mechanisms for selectively mating with and retaining the pins of an associated attachment, often without requiring an operator of the excavator to leave the operator's cab.

In either case, once the implement is connected to the arm of the excavator or other apparatus, the structural relationship between the implement cylinder and the implement (i.e., the implement linkage), itself, is fixed and may not be varied to change the speed and force characteristics of the linkage arrangement. Thus, with conventional implement linkages, exertion of a select force (F) on the implement link member results in a select amount of the force (X*F) being transferred to the implement, wherein the parameter (X) is fixed and cannot be varied. Likewise, movement of the implement cylinder with a select speed (V) results in movement of the implement, itself, at a speed (Y*V), wherein the parameter (Y) is fixed and cannot be varied. Thus, the speed/force characteristics of the linkage are fixed and are often sub-optimal for a particular task.

In practice, when excavating sand or other soft, easily displaced materials, it is desirable to excavate with more speed; however, less force is required. In contrast, if excavating clay, mud, or other packed, dense materials, more force is required, and speed is of less importance. Therefore, an excavator or other machine with a conventional, fixed implement linkage will be used inefficiently and in a manner that increases expenses for labor and equipment, and that also decreases project efficiency overall. Also, improper speed/force characteristics for a particular excavating or other task can unnecessarily strain fluid cylinders and other components.

In light of the foregoing specifically noted deficiencies and others associated with prior fixed implement linkages, a need has been identified for a new and improved implement linkage for an excavator or like apparatus wherein the speed and force characteristics of the linkage are adjustable by and end-user as desired based upon the task to be performed.

SUMMARY OF THE INVENTION

In accordance with the present invention, a novel and non-obvious implement linkage for an excavator, backhoe, or like apparatus is provided wherein the speed and force (speed/force) characteristics of the linkage, and the implement connected thereto, are selectively variable by an end-user depending upon the task to be performed with the implement.

One advantage of the present invention resides in the provision of an implement linkage for an excavator or like apparatus wherein the implement linkage is adjustable by an end-user in the field to vary the speed/force characteristics of the linkage and an implement operatively coupled thereto.

Another advantage of the present invention is found in the provision of a speed/force adjustable implement linkage for an excavator or the like that allows for convenient and rapid speed/force adjustments to be made to the linkage, without disconnecting the associated implement from the linkage.

Still another advantage of the present invention is the provision of a speed/force adjustable implement linkage for an excavator or the like that does not add significant weight to the arm or boom of the excavator or other unit to which the associated implement is connected, and that is usable without requiring any modifications to the bucket or other associated implement to be operatively coupled thereto.

Yet another advantage of the present invention resides in the provision of a speed/force adjustable implement linkage for an excavator or other apparatus that allows the excavator or other apparatus to be used with optimum efficiency.

A further advantage of the present invention is found in the provision of a speed/force adjustable implement linkage that minimizes undue strain on the fluid cylinders that operate the linkage and implement and on the linkage assembly, itself.

Still other benefits and advantages of the present invention will become apparent to those of ordinary skill in the art to which the invention pertains upon reading and understanding the following specification.

BRIEF DESCRIPTION OF THE DRAWINGS

The invention takes form from various components and arrangements of components, preferred embodiments of which are illustrated in the accompanying drawings that form a part hereof and wherein.

DETAILED DESCRIPTION OF THE PREFERRED EMBODIMENTS

Figure 1:
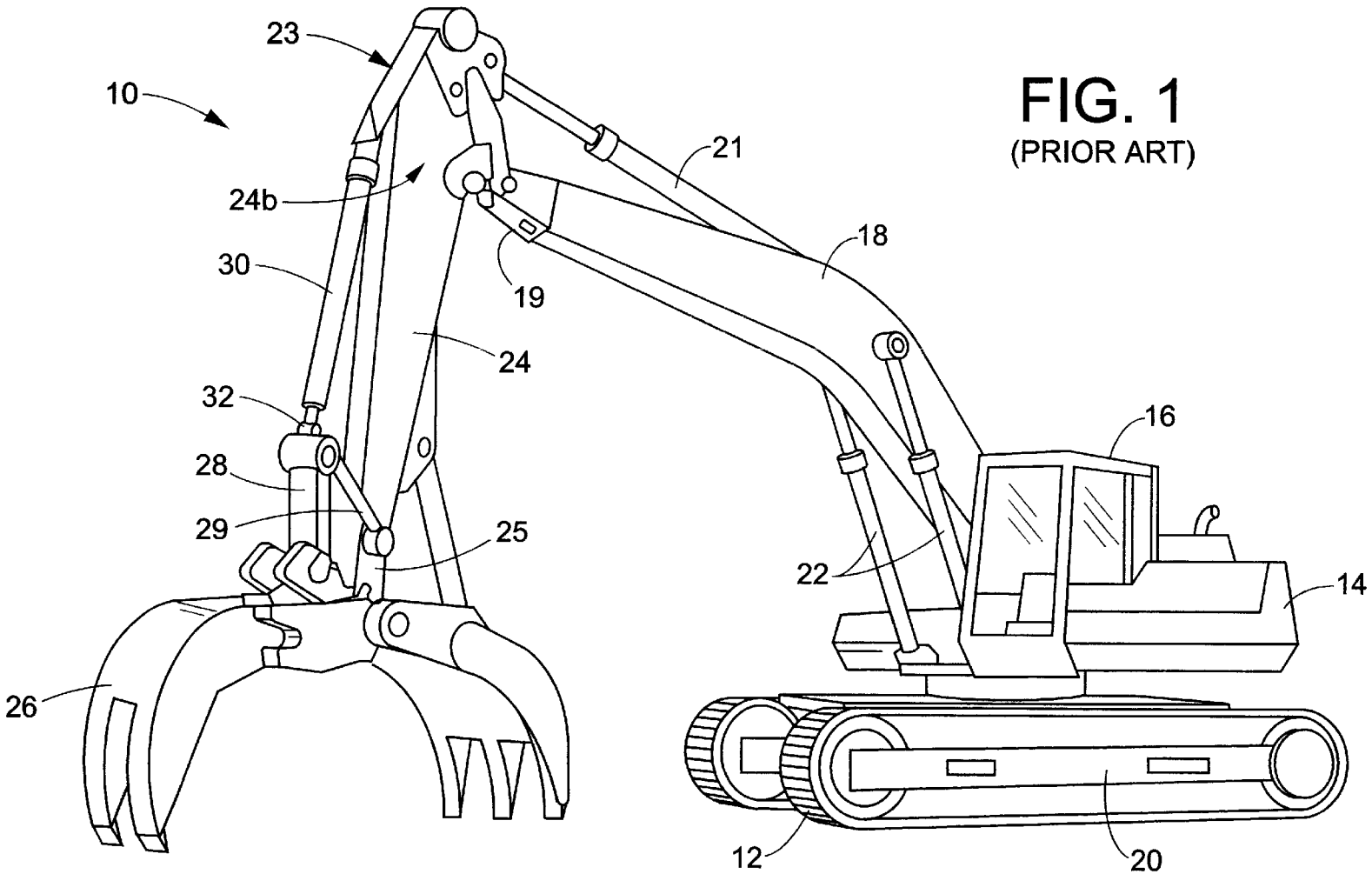
FIG. 1 (PRIOR ART)
FIG. 1 illustrates a conventional excavator or like apparatus and an associated implement or attachment operatively coupled to an arm of the excavator by a conventional implement linkage.

Referring now to the drawings, wherein the showings are for purposes of illustrating preferred embodiments of the invention only and not for purposes of limiting same, FIG. 1 illustrates one example of an excavator of the type in connection with which a speed/force adjustable bucket linkage formed in accordance with the present invention may be advantageously employed. The excavator 10, which is illustrated in FIG. 1 with a conventional implement linkage, is movable upon tractor or roller chain treads 12 in standard fashion. An engine or power unit 14, such as a diesel engine or the like, is operative to drive the treads 12 and the various hydraulic pumps, generators, and systems employed in the operation of the excavator as is well known. A cab 16 is maintained upon a base 20 for accommodating an operator controlling the excavator 10.

A boom 18 extends upwardly from the base 20 and is movable in elevation by means of hydraulic pistons 22. At the distal end 19 of the boom 18, the proximal end 23 of an arm or "dipper stick" 24 is pivotally attached. In the embodiment shown, a shovel, bucket, or other implement 26 is maintained at the distal end 25 of the arm 24. An implement fluid cylinder 30 is operatively connected to the arm 24, and an implement or "bucket" link member 28 connects a piston 32 of the cylinder 30 to the bucket 26 or other implement to control operation of same as is well known and understood by those skilled in the art. Guide links 29 (only one visible in FIG. 1) are located on opposite lateral sides of the arm 24 and are pivotally connected to both the arm 24 and the implement link 28. The guide links 29 maintain proper spacing between the implement link member 28 and the arm 24 during extension/retraction of the cylinder piston 32. In similar fashion, a fluid cylinder 21 is interposed between the boom 18 and arm 24 for achieving pivotal movement between these two members, again in a fashion well known and understood in the art.

Figure 2:
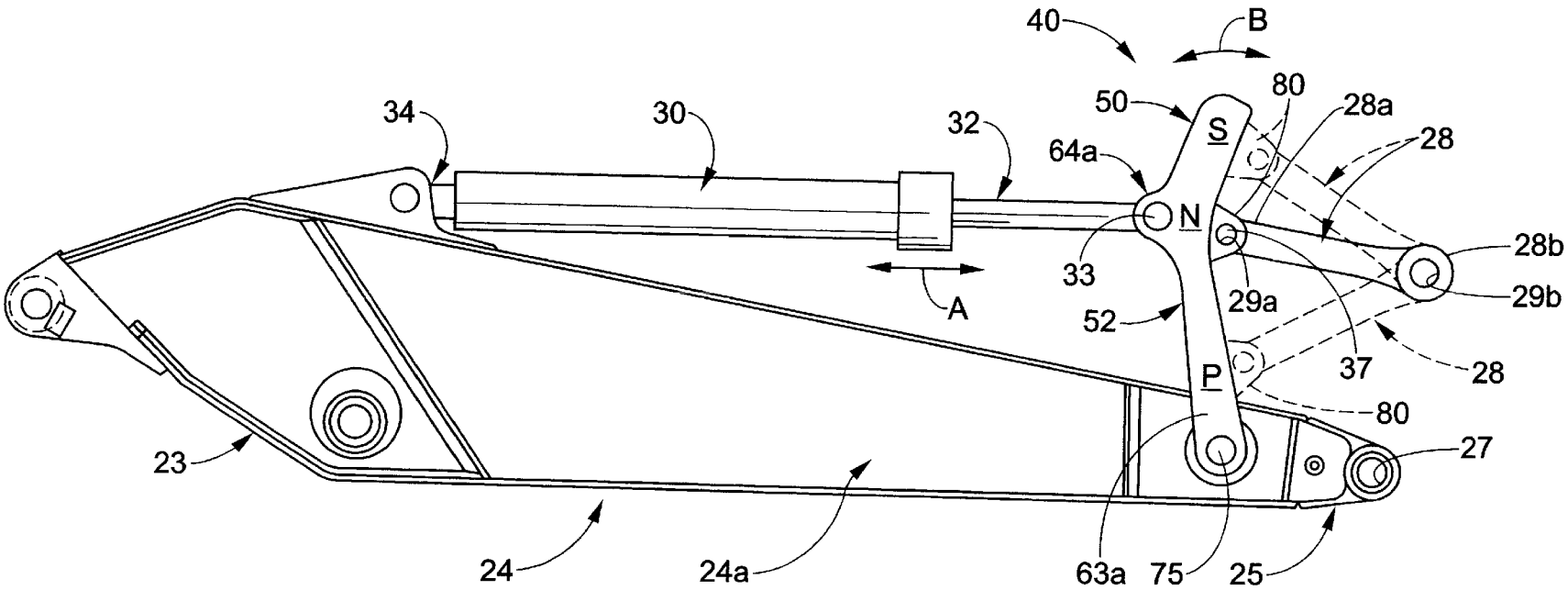
FIG. 2 is a side elevational view of an arm for an excavator, backhoe, or like apparatus incorporating speed/force adjustable implement linkage formed in accordance with the present invention.
Figure 3:
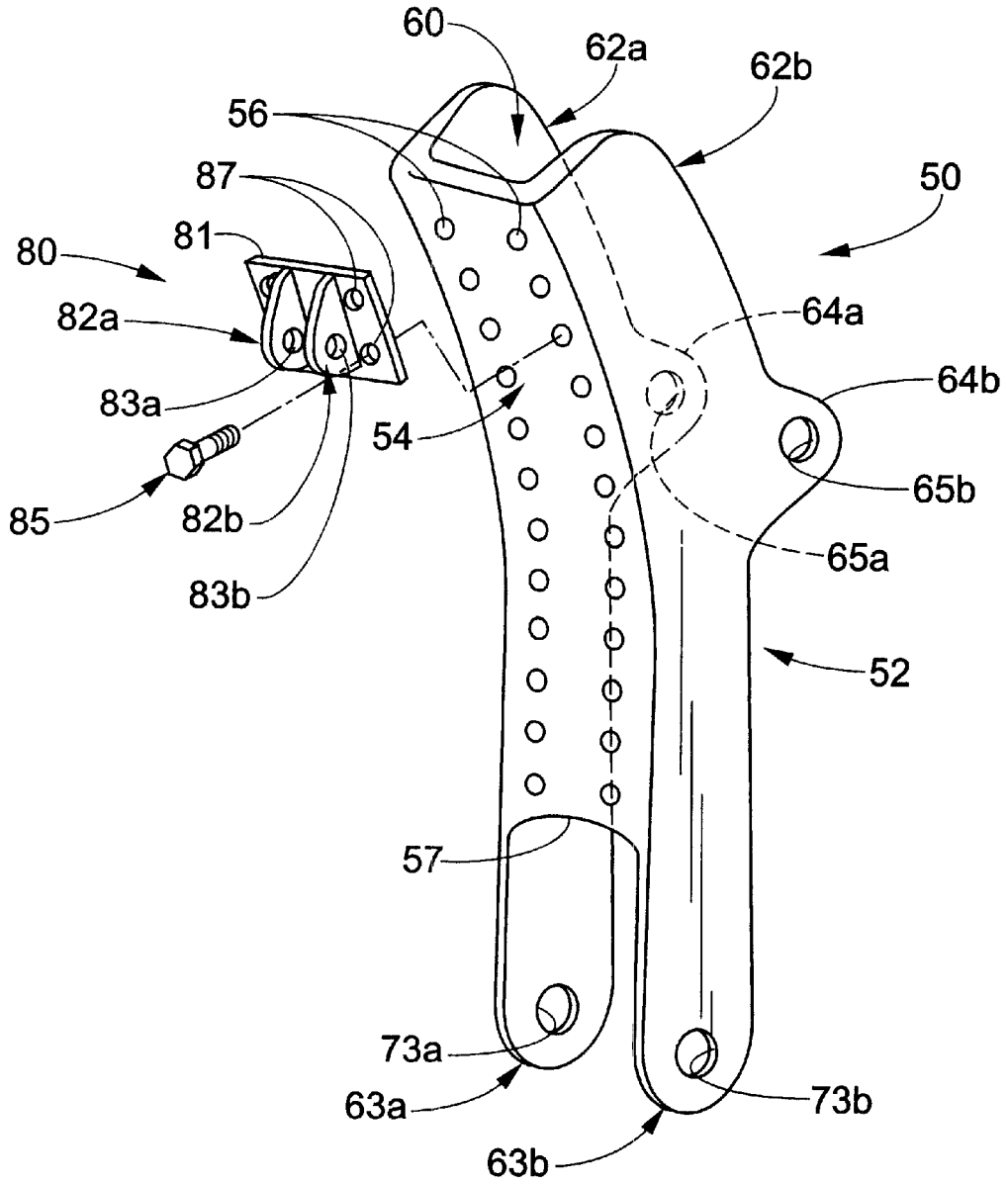
FIG. 3 is an exploded perspective view of a guide link assembly that forms a part of a speed/force adjustable implement linkage in accordance with the present invention.

With reference now to FIGS. 2 and 3, the arm 24 of an apparatus such as the excavator 10 is shown and includes a speed/force adjustable implement linkage 40 formed in accordance with the present invention. Components of the arm 24 that are the same or similar to those shown in FIG. 1 are identified in FIG. 2 with like reference numerals. The subject linkage 40 comprises three main components, all fabricated from conventional steel or another suitable material using conventional methods: (i) a guide link member 50; (ii) an implement link member 28; and, (iii) an interface member 80 adapted for interconnecting the guide link member 50 and a first end 28*a* of the implement link member 28.

With particular reference now to FIG. 3, the guide link member 50 defines fist and second sidewalls 62*a*,62*b* interconnected by a face member 54 so that a channel 60 is defined and opens in a rear region 52 of the guide link member 50. The sidewalls 62*a*,62*b* define cylinder attachment regions or lobes 64*a*,64*b* that respectively include apertures 65*a*,65*b* that are aligned with each other. A distal portion of the cylinder piston 32, itself, or a member secured thereto, is received in the channel 60 and defines an aperture that is adapted for being placed in alignment with the apertures 65*a*,65*b*. A pin 33 (FIG. 2) is inserted through the aligned apertures 65*a*,65*b* and aperture defined by the cylinder piston 32 or member connected thereto so as to pivotably interconnect the cylinder piston 32 to the rear region 52 of the guide link member 50.

The front face 54 of the guide link member 50 is conformed so that an open region or notch 57 is defined between the sidewalls 62*a*,62*b* in an inner portion thereof. The notch 57 is adapted for loosely receiving the arm 24 therein so that innermost portions 63*a*, 63*b* of the sidewalls 62*a*,62*b* lie adjacent respective lateral walls 24*a*,24*b* (see also FIG. 1) of the arm 24. The inner portions 63*a*,63*b* of the guide link member 50 respectively define aligned apertures 73*a*, 73*b*, and a pin 75 (FIG. 2) is inserted through these and the arm 24 (or separate pins are used) so as to pivotably interconnect the inner end of the guide link member 50 to the arm 24 as illustrated. Owing to the pivotable interconnection between the piston 32 and the guide link member 50, and the pivotable interconnection between the guide link member 50 and the arm 24, those of ordinary skill in the art will recognize that axial movement (as indicated by the arrow A) of the cylinder piston 32 under fluid pressure will cause the guide link member 50 to pivot about the pin(s) 75 relative to the arm 24 on an arc indicated by the arrow B. Of course, as is conventional, this action is also made possible due to the pivotable connection of the fluid cylinder 30 to the arm 24 at its opposite, proximal end 34 by a pin or other suitable means.

The implement link 28 is conventional and includes a first end 28*a* defining an aperture 29*a* adapted for pivotable connection to the guide link member 50, and a second end 28*b* defining an aperture 29*b* that is adapted for connection to an associated implement (or a quick-coupler that is, in turn, adapted for operative connection to an associated implement) The distal end 25 of the arm 24 defines an aperture 27 in a conventional manner. Thus, with reference now also to FIG. 4, an implement such as a bucket 26 is pivotably secured to the distal end 25 of the arm 24 by way of a pin 35*a* inserted through the aperture 27 and aligned apertures in the implement 26, and also pivotably secured to the second end 28*b* of the implement link member 28 by a pin 35*b* inserted through the aperture 29*b* and aligned apertures in the implement 26. Accordingly, the implement 26 is adapted for pivoting movement relative to the distal end 25 of the arm 24 on an arc C about the pin 35*a*.

Operative connection of the implement 26 to the guide link member 50 is effected by way of an interface member 80 that connects to both the guide link member 50 and the implement link 28. With reference to FIG. 3, the interface member defines ears or lobes 82*a*,82*b* that project outwardly and forwardly from a base plate 81. The ears 82*a*,82*b* include or define aligned apertures 83*a*,83*b*, respectively, and the space between the ears is adapted for receipt of the first end 28*a* of the implement link member 28 so that the aperture 29*a* in the first end of the link member is aligned with the apertures 83*a*,83*b*. A pin 37 (FIG. 2) is inserted through all of the apertures 83*a*,83*b*,29*a* to pivotably interconnect the implement link member 28 to the interface member 80.

The interface member 80 is, in turn, fixedly secured to the face 54 of the guide link member 50 at any one of a plurality of different locations as illustrated in FIG. 2 in both solid and broken lines: (i) a "neutral" position N (with the member 80 illustrated in solid lines) wherein the interface member 80 is connected to the face 54 of the guide link member 50 at a point directly opposite the cylinder attachment regions 64*a*, 64*b*; (ii) a "power" position P wherein the interface member 80 is located between the neutral position N and the arm 24; and, (iii) a "speed" position S wherein the interface member 80 is spaced farther away from the arm 24 relative to the "neutral" position N.

In the illustrated embodiment best seen with reference to FIG. 3, the base plate 81 of the interface member 80 includes a plurality of apertures 87 therein. The face 54 of the guide link 50 includes a plurality of threaded bores 56 therein and arranged so that the apertures 87 of the interface member 80 are selectively alignable therewith when the interface member is placed in one of its operative positions, i.e., the "neutral" N, "power" P, and "speed" S positions. Fasteners, such as threaded bolts 85 (only one illustrated in FIG. 3 for clarity), are inserted into the apertures 87 and mated in an aligned one of the threaded bores 56 to releasably and fixedly secure the interface member 80 to the face 54 of the guide link member 50 in one of its operative positions N,S,P. Of course, those of ordinary skill in the art will recognize that the guide link member 50, itself, can include or define integral ears 82*a*,82*b* or other means at a plurality of locations on the face 54 member and adapted for pivotable interconnection with the first end 28*a* of the implement link member 28. Further, means other than the aligned apertures 87,56 and bolts 85, can be used to secure the interface member 80 in a selectively movable manner to the guide link member 50, and it is not intended that the invention be limited to any particular securing arrangement. For example, an electric and/or hydraulic actuator assembly can be used to selectively move the interface member 80 relative to the guide link member 50 and fix same in one of the operative positions N,P,S. Regardless of the particular structure used, it is preferred that the face 54 of the guide link member 50 be defined in an arcuate manner as shown with a radius R5 centered at the pin 35*b*. Thus, in the preferred embodiment, the apertures 83*a*,83*b* (FIG. 3) of the interface member 80 are always located on a radius R3 that is also centered at the pin 35*b*. Accordingly, for a given position of the implement 26 relative to the guide link 50, the radii R3,R5 have the same center so that regardless of the position of the interface member 80 on the guide link member, the implement 26 will be in an identical position for a given position of the guide link member 50.

Figure 4:
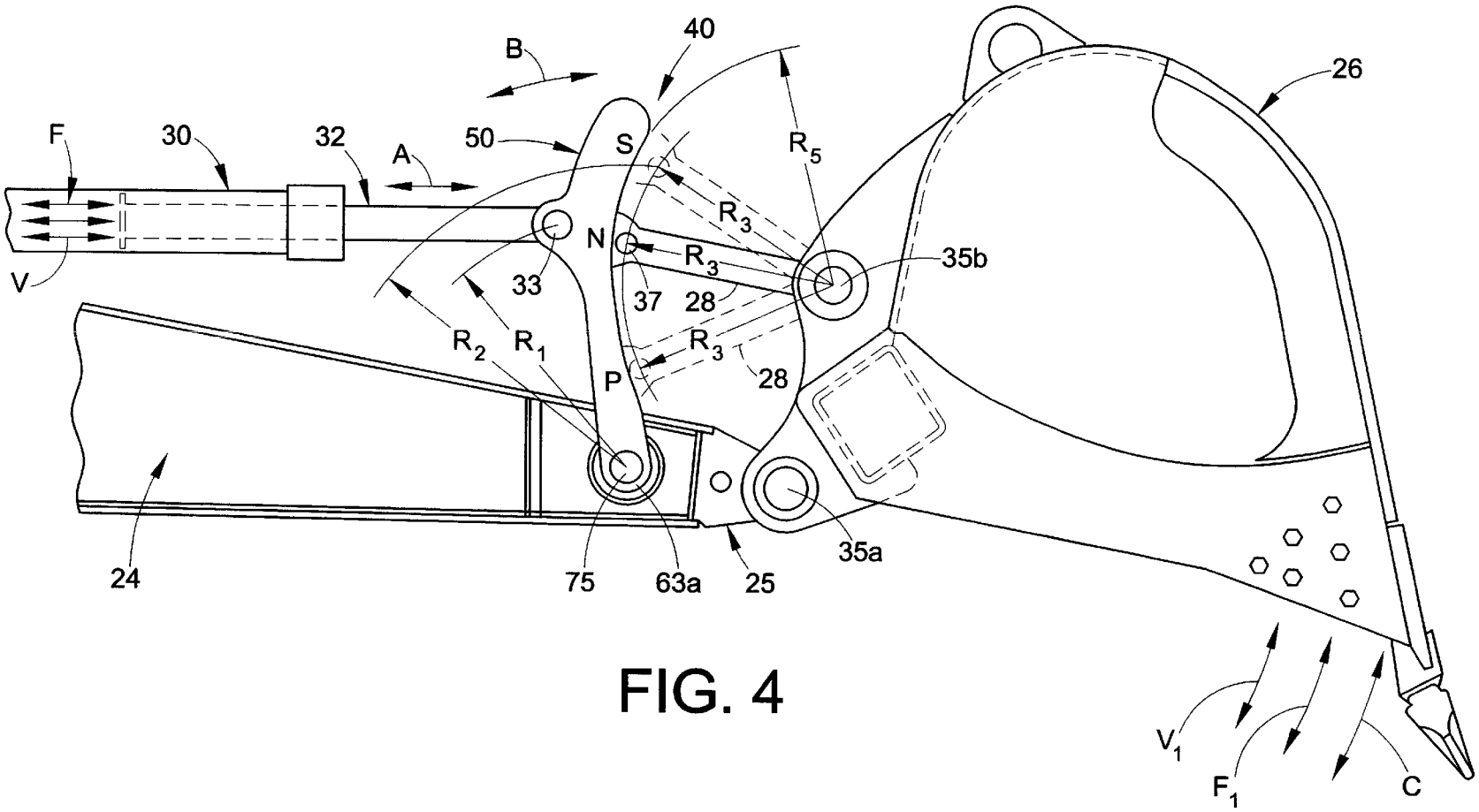
FIG. 4 is an enlarged partial side elevational view of the arm and linkage of FIG. 2 showing operative attachment of an associated implement to the arm by way of the speed/force implement linkage formed in accordance with the present invention.

With particular reference now to FIG. 4, operation of the subject speed/force adjustable implement linkage 40 is explained. Reciprocal movement of the cylinder piston 32 (as indicated by the arrow A) with a speed V and force F moves the guide link 50 in a reciprocal manner on an arc B about the pin(s) 75. The guide link 50 transfers force to the implement link 28 and associated implement 26 connected thereto so that the implement 26 pivots on an arc C about the pin 35*a* with a speed V1 and force F1. A fixed radius R1 is defined by the distance between the pins 75,33. A radius R2 is defined between the pins 75,37, and this radius R2 varies depending upon the operative position of the interface member 80. It can be seen that, when the interface member 80 is in the "neutral" position N, the radii R1,R2 are at least substantially equal (R1=R2); when the interface member 80 is in the "power" position P, the radius R2 is less than the radius R1 (R2<R1); and, when the interface member 80 is in the "speed" position S, the radius R2 is greater than the radius R1 (R2>R1). From this, those of ordinary skill in the art will recognize that in the "neutral" position N of the implement member 80 (R1=R2), the speed and force V,F with which the cylinder piston 32 moves will be transferred to the implement link member 28 and the implement 26 in a conventional manner. However, when the interface member 80 is in its "power" position P (R2<R1), the implement link member 28 and implement 26 will move with less speed than the cylinder piston 32, but with greater force. Conversely, when the interface member 80 is in its "speed" position S (R2>R1), the implement link member 28 and implement 26 will move with greater speed and less force as compared to the piston cylinder 32. Thus, the speed (V1) of the implement 26 is proportional to the speed (V) of the cylinder piston 32 multiplied by the ratio of the radius R2 to the radius R1 according to:

$$V1\ V*R2/R1$$

Similarly, the force (F1) of the implement 26 is proportional to the force (F) of the cylinder piston 32 multiplied by the ratio of the radius R1 to the radius R2 according to:

$$F1\ F*R1/R2$$

Thus, using a speed/force adjustable implement linkage 40 formed in accordance with the present invention, an end-user can alter the speed/force characteristics of the linkage 40 and the implement 26 to optimize same depending upon the task to be performed simply by changing the position at which the interface member 80 is connected to the guide link member 50. This allows the end-user to choose either: a medium cycle time with medium force; a slow cycle time with high force; or, a fast cycle time with low force.

The invention has been described with reference to preferred embodiments. Of course, modifications and alterations will occur to others upon a reading and understanding of the preceding specification. It is intended that the invention be construed as including all such modifications and alterations.

Having thus described the preferred embodiments, what is claimed is:

1. An arm assembly for an excavation apparatus, said arm assembly comprising:

an arm;

a guide link having a first portion pivotably connected to said arm at a first pivot point;

a fluid cylinder operatively coupled to said guide link at a second pivot point whereby a pivot radius is defined between said first and second pivot points;

an implement link having: (i) a first end operably coupled to said guide link at one of a plurality of different operative locations on said guide link, each of said plurality of different operative locations spaced a different distance from said first pivot point, wherein said first end of said implement link is selectively movable relative to said guide link to a different one of said plurality of different operative locations; and, (ii) a second end adapted for operative connection to an associated implement.

2. The arm assembly as set forth in claim 1, wherein said plurality of different locations comprises at least three different locations so that at least three of said different distances are defined, wherein a first one of said different distances is greater than said pivot radius, a second one of said different distanced is less than said pivot radius, and a third one of said different distances is less than said first distance and greater than said second distance.

3. The arm assembly as set forth in claim 2, wherein said third one of said different distances is equal to said pivot radius.

4. The arm assembly as set forth in claim 1, further comprising:

an interface member located operatively between said implement link and said guide link, said interface member comprising: (i) a first portion pivotably connected to said first end of said implement link; and, (ii) a second portion connected to one of said plurality of different locations on said guide link.

5. The arm assembly as set forth in claim 4, wherein said second portion of said interface member defines a plurality of apertures, wherein said guide link defines a plurality of threaded bores, and wherein said second portion of said interface member is connected to said guide link by a plurality of fasteners inserted through said plurality of apertures, respectively, and into aligned ones of said plurality of threaded bores.

6. The arm assembly as set forth in claim 1, wherein said guide link is conformed so that a fixed select distance is defined between said second end of said implement link and said second pivot point when said first end of said implement link is connection to any one of said plurality of different operative locations on said guide link.

7. An adjustable link assembly comprising:

a guide link adapted for pivotable connection to an associated arm at a first pivot point and pivotable operative connection to an associated fluid cylinder at a second pivot point, so that a fixed radius (R1) is defined between said first and second pivot points and said second pivot point moves relative to said first pivot point along said radius;

an implement link having a first end and an opposite second end, said second end adapted for operative connection to an associated implement; and, an interface assembly operatively connecting said first end of said implement link to said guide link so that said implement link moves together with said guide link when said guide link pivots about said first pivot point, said interface assembly selectively adjustable so as to move said first end of said implement link selectively relative to said guide link and alter speed/force characteristics of said adjustable link assembly, whereby an adjustable radius (R2) is defined between said first pivot point about which said guide link pivots and said first end of said implement link depending upon a relative position of said interface assembly and said guide link, said guide link moving said implement link member with different speed/force characteristics depending upon a length of said adjustable radius.

8. The adjustable link assembly as set forth in claim 7, wherein said interface assembly is selectively fixedly secured to said guide link by threaded fasteners.

* * * * *